US010145149B2

(12) United States Patent
Westwinkel et al.

(10) Patent No.: US 10,145,149 B2
(45) Date of Patent: Dec. 4, 2018

(54) CAMMED LEVER-ACTIVATED LOCKING SYSTEM

(71) Applicants: 2603701 ONTARIO INC., Etobicoke (CA); Gabriele Theresia Westwinkel

(72) Inventors: Florian Westwinkel, Toronto (CA); Tonino Sabelli, Oakville (CA)

(73) Assignee: 2603701 Ontario Inc., Etobicoke, ON (CA)

( * ) Notice: Subject to any disclaimer, the term of this patent is extended or adjusted under 35 U.S.C. 154(b) by 0 days.

(21) Appl. No.: 14/259,805

(22) Filed: Apr. 23, 2014

(65) Prior Publication Data

US 2015/0218859 A1 Aug. 6, 2015

(30) Foreign Application Priority Data

Feb. 6, 2014 (CA) ..... 2841690
Mar. 27, 2014 (CA) ..... 2847639

(51) Int. Cl.
*E05B 65/464* (2017.01)

(52) U.S. Cl.
CPC ..... *E05B 65/464* (2013.01); *Y10T 70/5097* (2015.04)

(58) Field of Classification Search
CPC ..... E05B 65/44; E05B 65/46; E05B 65/462; E05B 65/463; E05B 65/464; E05B 65/465; E05B 65/468; E05C 3/006
USPC ..... 312/216–222; 70/107.5, 78–87
See application file for complete search history.

(56) References Cited

U.S. PATENT DOCUMENTS

| | | | |
|---|---|---|---|
| 78,449 | A | 6/1868 | Gibbs |
| 428,941 | A | 5/1890 | Pauly, Sr. |
| 1,324,162 | A | 12/1919 | Lau |
| 1,422,631 | A | 7/1922 | Stafford |
| 3,029,118 | A | 4/1962 | Schuette |
| 3,046,777 | A | 7/1962 | Schlage |
| 3,497,280 | A | 2/1970 | Olree et al. |
| 3,589,783 | A | 6/1971 | Studinski et al. |
| 3,866,993 | A | 2/1975 | Dean et al. |
| 3,888,558 | A | 6/1975 | Himsl |
| 3,900,236 | A | 8/1975 | Goulish et al. |
| 3,969,008 | A | 7/1976 | Pergler |
| 3,998,508 | A | 12/1976 | Scheerhorn |
| 4,239,309 | A | 12/1980 | De Fouw et al. |
| 4,355,851 | A | 10/1982 | Slusser |
| 4,429,930 | A | 2/1984 | Blouin |

(Continued)

*Primary Examiner* — Peter M. Cuomo
*Assistant Examiner* — Amanda L Bailey
(74) *Attorney, Agent, or Firm* — Squire Patton Boggs (US) LLP

(57) ABSTRACT

A cammed lever is configured to nest and lock with a cam follower at a recess formed on the cammed lever or the cam follower. Upon rotation of the lever, the cam follower and the cammed lever are disengaged at the recess to form a gap when the cammed lever is rotated upon outward movement of a drawer or drawer slide. The lock assembly includes the cammed lever and cam follower in a stacked array for use in a storage unit having multiple drawers. Preferably, only one drawer is permitted to open in the stacked array. The cammed lever, when unlocked, is permitted to rotate between the open and closed positions. When locked, the cam follower prevents rotation of the cammed lever to an open position. An optional sliding bracket is provided for added security when the drawers are locked.

40 Claims, 10 Drawing Sheets

(56) References Cited

U.S. PATENT DOCUMENTS

| | | | | |
|---|---|---|---|---|
| 4,637,667 | A | | 1/1987 | Reid et al. |
| 4,662,689 | A | | 5/1987 | Chatterson et al. |
| 4,662,776 | A | | 5/1987 | Hedstrom et al. |
| 4,820,002 | A | | 4/1989 | Lechner et al. |
| 4,838,624 | A | | 6/1989 | Walla |
| 4,925,257 | A | | 5/1990 | Frederiksen et al. |
| 4,936,640 | A | | 6/1990 | Pratzer |
| 5,056,876 | A | | 10/1991 | Scheerhorn |
| 5,056,877 | A | * | 10/1991 | Westwinkel ..... E05B 65/464 312/217 |
| 5,062,678 | A | | 11/1991 | Westwinkel |
| 5,074,627 | A | | 12/1991 | Broeders |
| 5,176,436 | A | | 1/1993 | Mitchell |
| 5,199,774 | A | | 4/1993 | Hedinger et al. |
| 5,303,994 | A | | 4/1994 | Elsholz et al. |
| 5,333,949 | A | | 8/1994 | McGregor |
| 5,387,032 | A | | 2/1995 | Reisbeck |
| 5,411,327 | A | | 5/1995 | Norton |
| 5,427,445 | A | | 6/1995 | Mitchell |
| 5,544,957 | A | | 8/1996 | Schmidt |
| 5,567,027 | A | | 10/1996 | McClung et al. |
| 5,599,078 | A | | 2/1997 | Dechene et al. |
| 5,702,167 | A | * | 12/1997 | Muller ..... E05B 65/464 312/217 |
| 5,839,803 | A | | 11/1998 | Lizell |
| 5,988,778 | A | | 11/1999 | Lammens |
| 6,109,708 | A | | 8/2000 | Walla et al. |
| 6,186,606 | B1 | | 2/2001 | Krei |
| 6,254,205 | B1 | | 7/2001 | Wright et al. |
| 6,450,596 | B1 | | 9/2002 | Lee |
| 6,550,876 | B2 | | 4/2003 | Lammens |
| 6,698,258 | B2 | | 3/2004 | Westwinkel |
| 6,932,445 | B2 | | 8/2005 | Chiu |
| 7,320,507 | B2 | | 1/2008 | White et al. |
| 7,520,576 | B2 | | 4/2009 | Ludwig et al. |
| 8,220,879 | B2 | | 7/2012 | Chen et al. |
| 8,277,000 | B2 | | 10/2012 | Huang |
| 8,371,664 | B1 | | 2/2013 | Chen |
| 2003/0141790 | A1 | | 7/2003 | Weng |
| 2007/0284976 | A1 | | 12/2007 | Huang |
| 2008/0074017 | A1 | | 3/2008 | Ruan et al. |
| 2008/0106175 | A1 | | 5/2008 | Huang |
| 2011/0127889 | A1 | | 6/2011 | Ludwig et al. |

* cited by examiner

CAMMED LEVER-ACTIVATED LOCKING SYSTEM

FIELD OF THE INVENTION

The present invention relates generally to storage units including cabinets, office furniture, lockers, and other locking structures and their components, including a cammed lever, a lock assembly, a locking system and a kit for installing a lock assembly in a storage structure.

BACKGROUND OF THE INVENTION

Various locking systems, including anti-tip locking systems used in multi compartment storage units are often plagued with security issues caused by mis-use, tampering, vandalism or ordinary wear and tear, over the operational life cycle of the locking systems. Similarly, there may be compatibility issues or operational limitations associated with existing systems which may be overcome with retro fit installations using improved locking system designs. A repair or installation of an improved lock system may also be used to provide additional features to enhance security, operational qualities and durability for existing storage units, storage structures and components within the lock systems provided in those structures. The present invention may also be used in association with original equipment manufactured (OEM) installations in addition to retro fit and repair applications.

Although this invention is not limited to use in connection with movable storage units which may topple over if two or more storage compartments are simultaneously opened, certain aspects of the present invention may be used to provide anti-tip improvements for movable storage structures such as filing and storage cabinets, office furniture and the like.

It is therefore desirable to provide a locking system which addresses one or more of these issues in a variety of applications and work environments.

SUMMARY OF THE INVENTION

The following represents a simplified summary of the disclosure in order to provide a basic understanding to the reader. This summary is not an extensive overview of the disclosure and it does not necessarily identify important/critical elements of the invention or delineate the scope of the invention. Its sole purpose is to present some concepts disclosed herein in a simplified form as a prelude to the more detailed description that is presented later.

The invention includes a cammed lever for use in association with a lock system for a storage structure, a lock assembly comprising the cammed lever for use in a storage structure, a locking system comprising the lock assembly for use in a storage structure, and a storage structure comprising one or more of the cammed lever, the lock assembly, and the locking system. The invention also includes a kit for installation of a lock assembly, a locking system, or the cammed lever in combination with other components for installation within a storage structure.

In one embodiment, a lock assembly comprises:

a stacked pair of sliding locking bars for use in an array of paired locking bars along a longitudinal axis, the stacked pair of locking bars comprising:

a first lock bar extending along the longitudinal axis for movement along the longitudinal axis in association with a cam follower, a second lock bar for movement in association with a cammed lever along the longitudinal axis from a closed position adjacent the first bar, the cammed lever defining an elongated body extending between a first end of the cammed lever defining a camming surface, the cam follower nesting in a recess in the camming surface when the second lock bar is in the closed position, and a second end of the cammed lever defining a lever tip for cooperative movement along with a drawer slide associated with a storage compartment, the lever tip inhibiting the opening of the drawer slide when the second lock bar is in the closed position, and when the associated drawer slide is extended laterally outwardly from the longitudinal axis, the lever tip moves to a corresponding open position as the cam follower moves out from the nesting recess and along the camming surface, to separate the cammed lever and the cam follower by a predetermined distance defining a gap.

In some embodiments, the gap may be defined adjacent one end of a track which defines the longitudinal axis, along which a number of the lock assembly components may travel during the opening and closing of the associated drawer slide and during the locking and unlocking of the locking assembly. In certain other embodiments, the gap may be configured between one lock assembly and an adjacent lock assembly. The gap may be occupied with a lock bar traveling into the gap, to lock the lock assemblies stacked in abutting arrangement in a stacked array of lock assemblies. The lock assemblies may be unlocked by withdrawing the lock bar from the gap, to allow one drawer slide associated with one storage compartment to open while preventing other drawer slides and their associated storage compartments from opening in the array of lock systems.

In an alternative embodiment, the cam follower and the cammed lever may be configured so that the cam follower defines the recess and the cammed lever defines a raised camming surface configured to nest within the recess of the cam follower when the lock assembly is in the closed position.

The cam follower and the cammed lever may be configured for cooperative displacement of one or both of the cammed lever and the cam follower along the longitudinal axis. For example, in some embodiments, the cammed lever may be fixed to a track defining the longitudinal axis and fixed to the storage structure so that the cam follower will travel along the track, when the cammed lever is activated during lateral outward movement of the associated drawer slide. In a locking system comprising a stacked array of two lock assemblies, the cammed levers in the two stacked lock assemblies may be secured at opposite ends of the track. Preferably, only one cam follower associated with one of the two lock assemblies is allowed to close the gap when its associated drawer slide is moved laterally outwardly and to inhibit simultaneous lateral outward movement of the other drawer slide. The gap defined between the two lock assemblies may be closable when one drawer slide is moved laterally outwardly and the gap may be lockable by operating a lock bar to occupy the gap when locked and to withdraw the lock bar from the gap when unlocked.

In yet another embodiment, the cammed lever abuts against the drawer slide (or against a feature defined on or by the storage compartment) such that during the cooperative movement of the drawer slide (or the feature) laterally outwardly and away from the longitudinal axis, the lever tip moves to its corresponding open position and cooperatively acts on the cam follower to, correspondingly, separate the cammed lever and the cam follower and to separate the first lock bar and the second lock bar by the predetermined distance.

One or more of the interactive components may be insulated to inhibit noise and/or may be protected against wear during operation. For example, the cammed lever and cam follower may include features to absorb or inhibit noise or reduce wear when abutting components come into contact. By way of further example, the cammed lever may be manufactured with a resilient but flexible thermoplastic element to absorb some of the forces arising during contact with the cam follower, the drawer slide, the storage compartment, or other component. In some instances, the absorptive and/or wear resistant thermoplastic element may be provided as a coating, layer, strip or projection extending across the camming surface or other contact surfaces on the cammed lever or other components.

In another aspect, a cammed lever defines an elongated body extending between a first end of the cammed lever for nested engagement with a cam follower. The cam follower or the cammed lever defines a recess and an adjacent camming surface and the other part is configured to snugly nest within the recess and to travel along the camming surface to achieve the desired separation corresponding to the predeterimined distance, along the longitudinal axis. In the preferred embodiment, the cam follower nests in a recess in the camming surface when the cammed lever is in a closed position or a locked position. A second end of the cammed lever defines a lever tip for cooperative movement together with—a drawer slide associated with a storage compartment. Preferably, the lever tip engages the drawer slide to inhibit the opening of the drawer slide when the cammed lever is in the locked position. In this embodiment, the lever tip cooperatively moves in association with the drawer slide when the cammed lever moves from the closed position to the open position. The activation and cooperative movement of the cammed lever and the drawer slide, leads to separation of the cammed lever from the cam follower by the predetermined distance. The predetermined distance defines a gap along a closed track. The cam follower moves from the recess and along the camming surface toward a final rest at which point the cam follower and cammed lever are separated by the predetermined distance measured along the track.

The lock assembly may also comprise an optional movable supplemental bracket element to provide additional security against tampering, unauthorized operation, or unintended movement of a drawer slide, storage compartment during use or operation of the lock assembly. The bracket may be configured to travel along the track, for example, to lock and unlock the storage compartment or drawer slide, for operation in cooperation with the cammed lever, cam follower and sliding bars incorporated within a locking system.

In certain embodiments, the lock assembly may be configured to provide enhanced anti-tip features to deter users or unauthorized persons from attempting to simultaneously open more than one drawer, tampering with the lock assembly components, preventing the proper operation (namely, the locking and unlocking) of the locking system, or gaining unauthorized access to the storage compartments in a storage structure. In some instances, the lock assembly components may be configured to interact with the operational components in a storage structure, to inhibit or prevent tampering with, or unauthorized access to, the operational components of the locking system when a storage compartment, for example, a drawer, is partially or fully withdrawn from a storage unit. For example, the cammed lever and the sliding bracket may be configured to cooperatively restrict access, from outside the storage unit, to the adjacent components of a lock assembly when a drawer, associated with the lock assembly, is partially or fully withdrawn from the storage unit. In some instances, the cammed lever and the sliding bracket may also be configured and positioned to operationally interact with a leading edge of a drawer slide to restrict unauthorized access to, or unauthorized operation of, the lock assembly when the storage compartment is open or closed.

The invention may be used in anti tip features in multi drawer storage compartments, cabinets, office furniture, and other storage structures. The invention may also be used in movable and fixed storage structures which are not susceptible to accidental upset or tipping over.

The invention may be embodied in a kit comprising the cammed lever and one or more other components such as the cam follower for retrofit installations in existing locking storage structures. The kit may also include a track component for movement of multiple lock assemblies along a longitudinal axis within the storage structure. For example, the track may be constructed with a C-shaped channel to secure the locking assembly for limited sliding movement along the longitudinal axis. In many instances, the limited movement of each lock assembly along the enclosed track will be defined by a gap of a predetermined distance sufficient to allow only one lock assembly in a stacked array to move from the unlocked position to the open position, thus allowing only one storage compartment movably mounted along the track to open when the drawer slide is extended laterally across the longitudinal axis.

One or more of the components of the lock assembly may be provided with track-slide features. For example, the cammed lever, cam follower, or bracket may be provided with, or mounted on, a T-shaped base for slide-fit travel within a C-shaped channel defined by the track. Other configurations and cooperative track designs may also be used.

It will be appreciated by those skilled in the art that one or more of the particular features or characteristics of one embodiment may be combined in suitable instances with other features or characteristics in other embodiments.

BRIEF DESCRIPTION OF THE DRAWINGS

Certain specific embodiments of the present invention are described with reference to the following drawings which are appended to the present application. The drawings are briefly described below.

Several preferred embodiments of the invention will be described in greater detail having regard to the following drawings in which.

Preferred embodiments of the invention will be described in detail having regard to the appended drawings. However, it will be understood that these examples illustrate certain embodiments of the invention and that the illustrated examples are not to be interpreted as limiting the scope of the invention. Persons skilled in the art will understand that the invention may be implemented for use in other forms, systems, and methods and that many other variations, modifications and embodiments fall within the scope of the invention.

DETAILED DESCRIPTION OF PREFERRED EMBODIMENTS OF THE INVENTION

A preferred embodiment of the invention is depicted in FIGS. 1A, 1B, 1C, 2A, and 3-7.

Figure 2A:
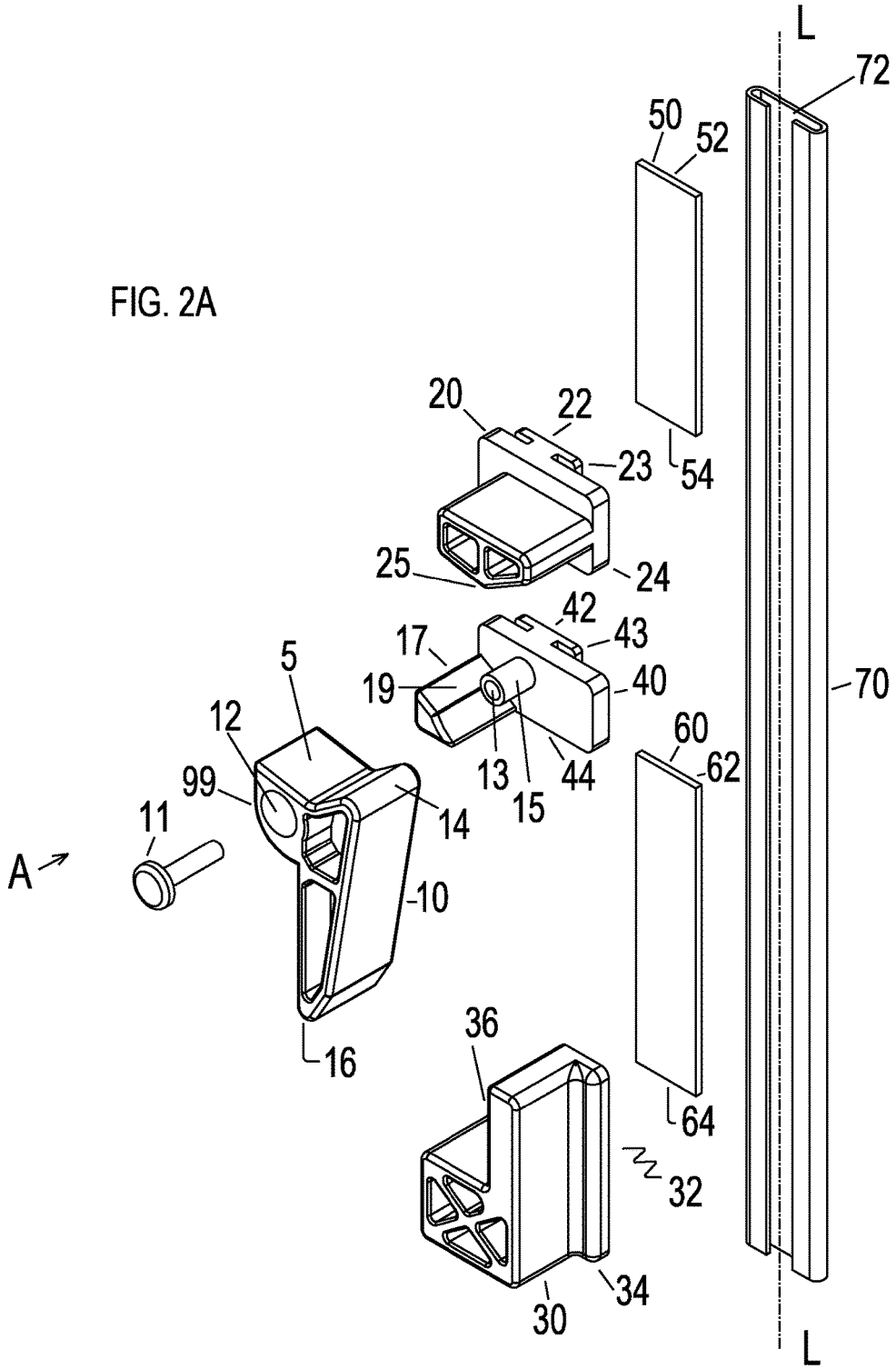
FIG. 2A shows an exploded side view, in perspective, of a lock assembly in a preferred embodiment of the invention.
Figure 2B:
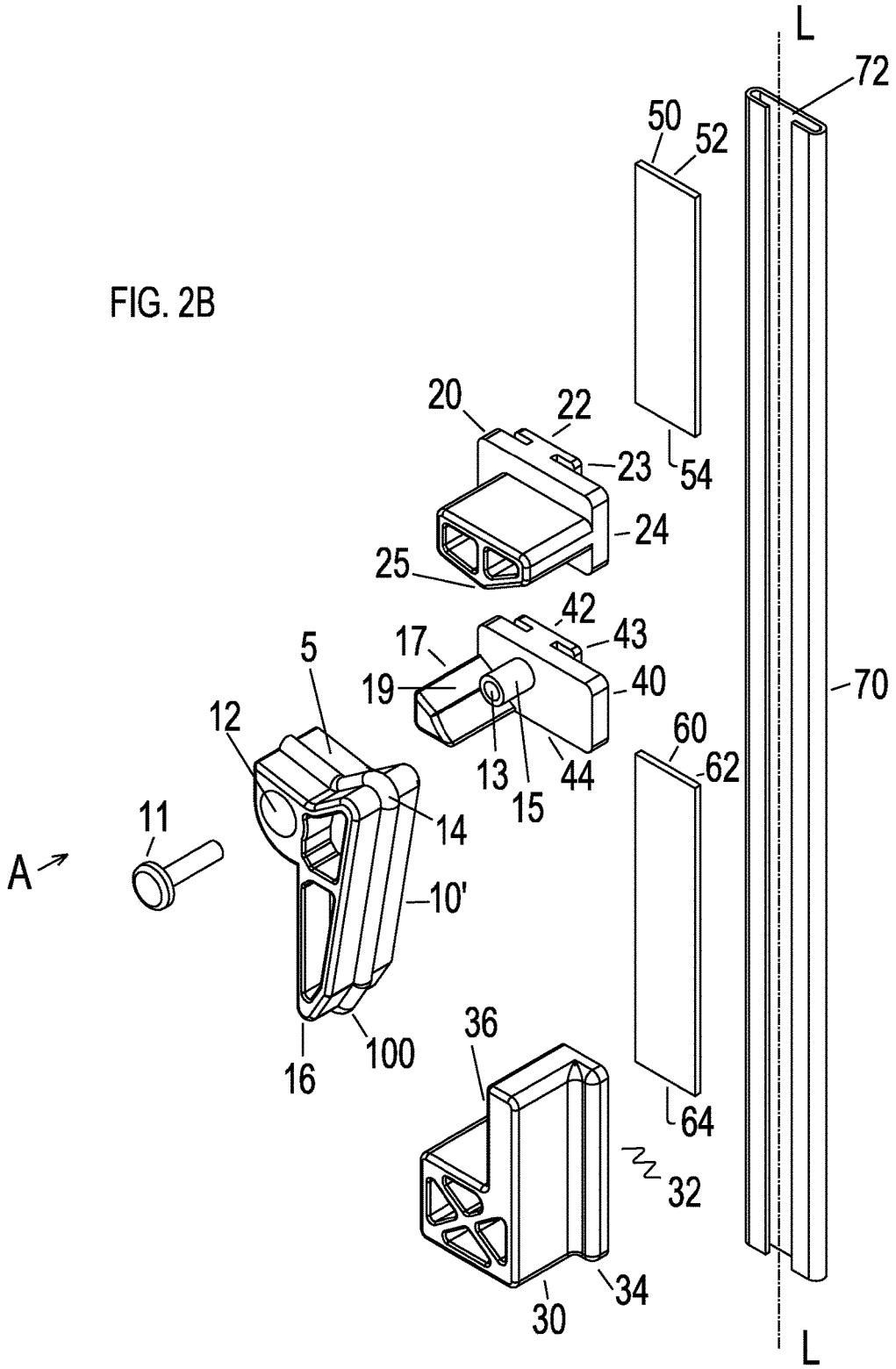
FIG. 2B shows an exploded side view, in perspective, of a variant of a lock assembly shown in FIG. 2A.
Figure 2C:
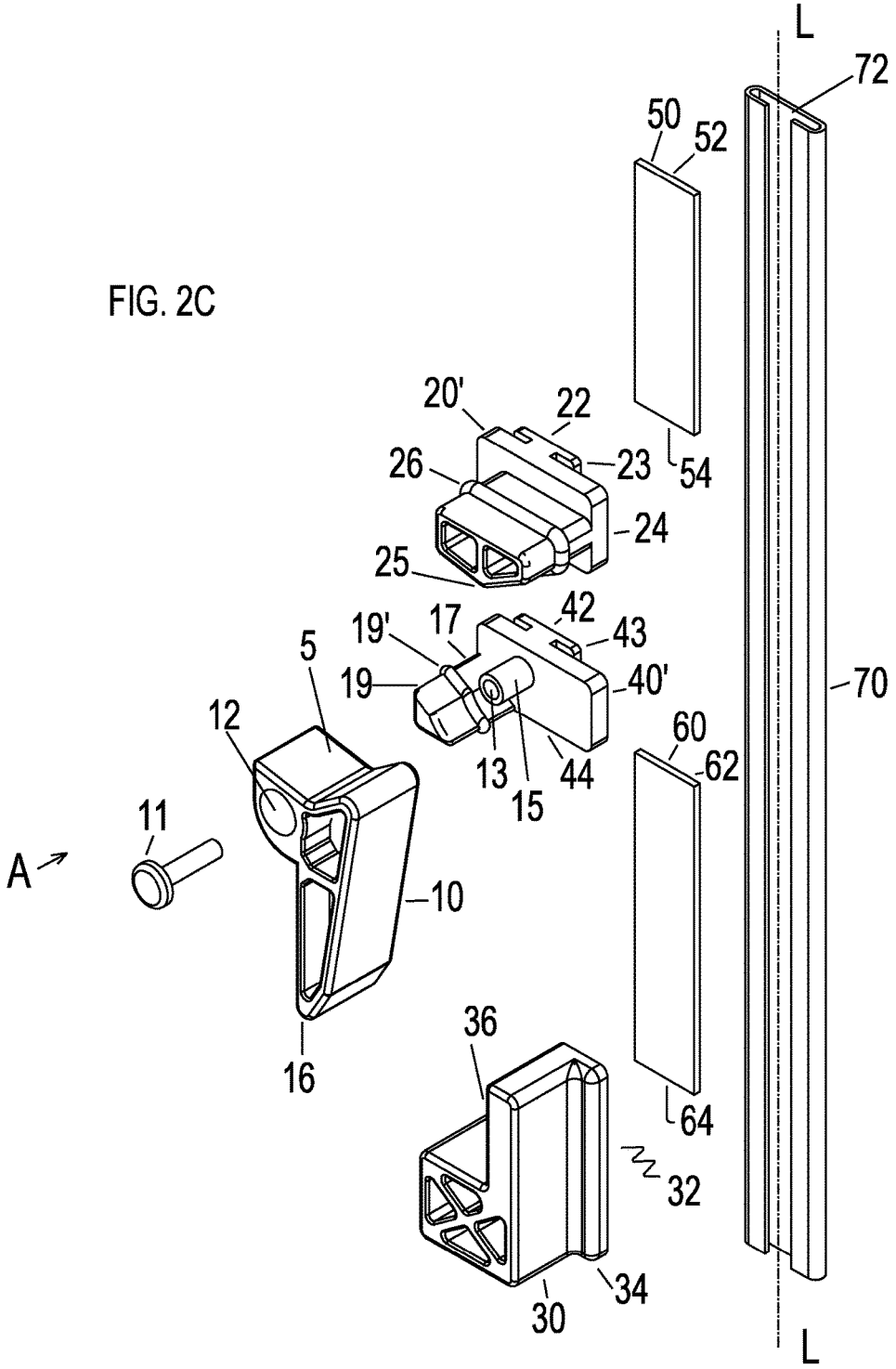
FIG. 2C shows an exploded side view, in perspective, of a second variant of the lock assembly of FIG. 2A.

Alternative embodiments of two other lock assemblies are illustrated in FIGS. 2B and 2C.

Figure 2D:
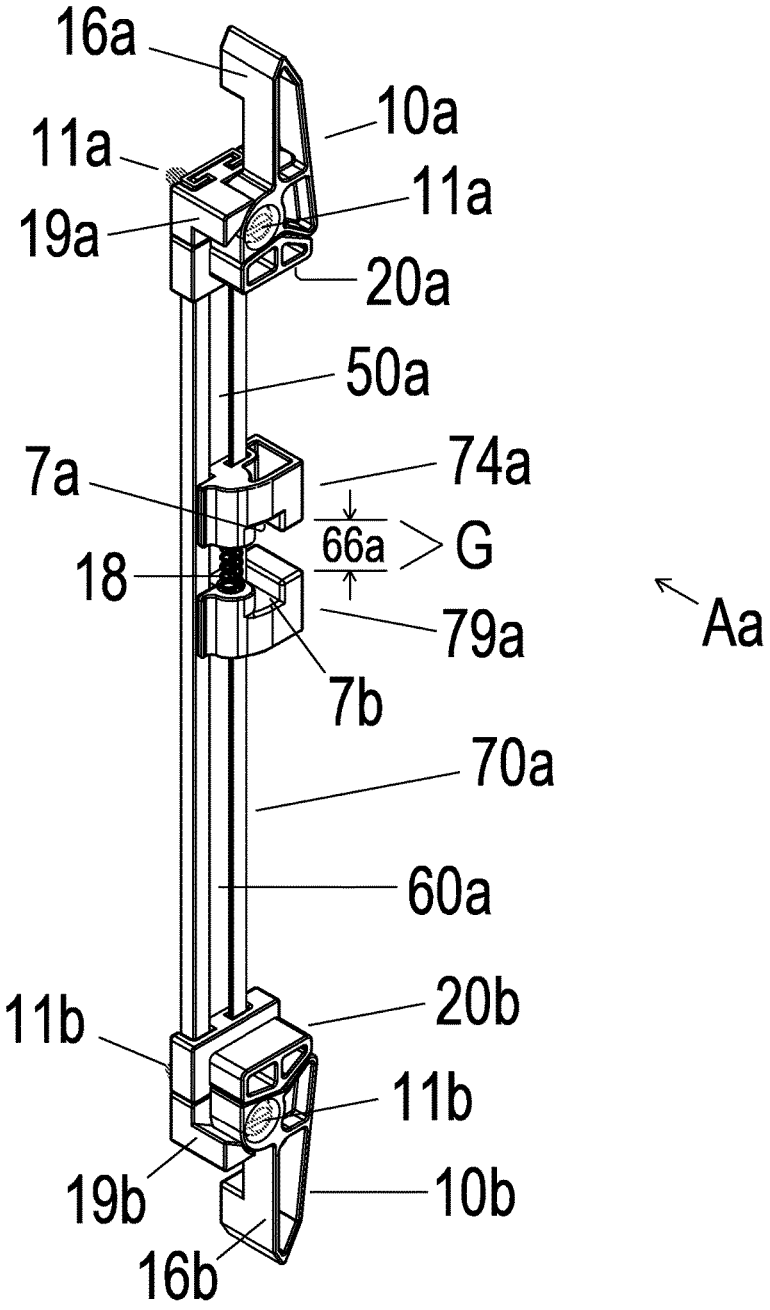
FIG. 2D shows a side view of another preferred embodiment, in perspective, of a two-drawer lock assembly.

Yet another preferred embodiment of the invention, namely a two-drawer lock assembly, is illustrated in FIG. 2D.

Figure 1A:
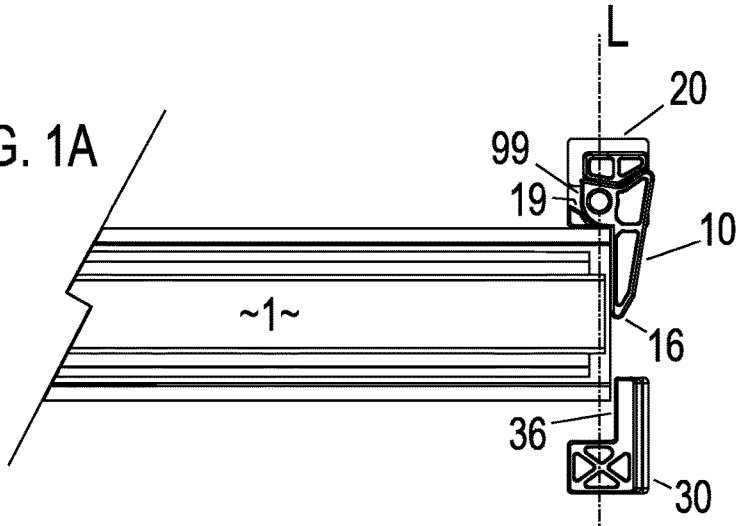
FIG. 1A is a simplified, partial sectional side view of a preferred embodiment of the invention illustrated in association with a progressive drawer slide, in which the illustrated drawer slide is shown supporting a storage drawer in a corresponding closed position.
Figure 1B:
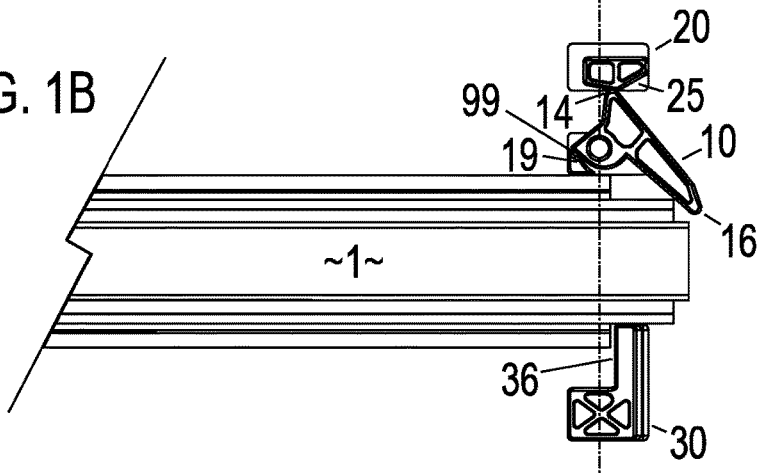
FIG. 1B shows the preferred embodiment in which the drawer slide is in motion.
Figure 1C:
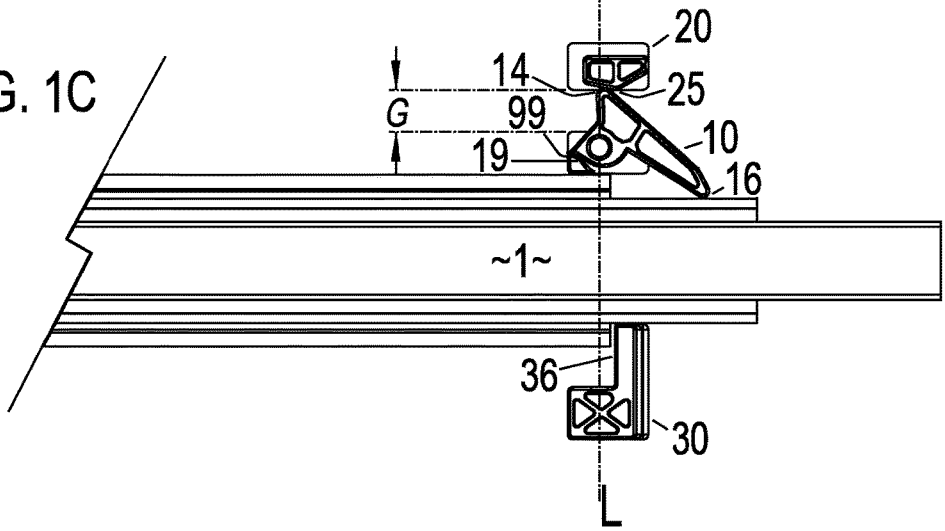
FIG. 1C shows the preferred embodiment in which the drawer slide is in an open position and the elements of the preferred locking system are in the open position.

With regard to FIGS. 1A, 1B and 1C, a drawer slide 1 is shown with a preferred embodiment of a cammed lever 10 engaged with cam follower 20. In FIG. 1A, the drawer slide 1 is in a closed position. An associated drawer or storage compartment (not shown) is also in a corresponding closed position. Cammed lever 10 is engaged with the leading edge of drawer slide 1, in substantial alignment along a longitudinal axis L (defined by a track, which is not shown). In this embodiment, lever tip 16 rests against the leading edge of the drawer slide 1. In other embodiments, the cammed lever may be configured and situated to abut against a surface, projection, or other feature provided on a drawer or other storage compartment. Cammed lever 10 rests against retainer 19. In FIG. 2A, the retainer 19 provides a backrest 17 configured as a stop to limit the rotational movement of cammed lever 10 during outward displacement of drawer slide 1. Optional bracket 30 is shown in a lowered, unlocked position (FIGS. 1A, 1B and 1C) to permit outward movement of drawer slide 1 during opening of the drawer or other storage compartment (not shown). Bracket tip 36 of bracket 30 is positioned below the bottom edge of drawer slide 1 when the cammed lever 10 is in the unlocked position. When the cammed lever 10 is the unlocked position, outward movement of drawer slide 1, across the longitudinal axis L, causes lever peak 14 to act across beveled surface 25 of cam follower 20, to displace and separate cammed lever 10 and cam follower 20 by the predetermined distance represented by the gap G. When the cammed lever 10 and cam follower 20 reach the predetermined distance represented by the gap G, in this embodiment, lever tip 16 engages the top surface of drawer slide 1 as illustrated in FIG. 1C.

As illustrated in FIG. 2A, a modular lock assembly A may include optional bracket 30, a cam follower 20, and cammed lever 10 mounted on lever base 40. Fastener 11 may be used to secure cammed lever 10 by inserting fastener 11 through opening 12 and into recess 13 in a manner that will permit rotational movement of cammed lever 10 about a rotational axis defined by mounting post 15. Cammed lever 10 and cam follower 20 are configured so that surface 25 is capable of nested, locking engagement with beveled recess 5 found at the camming end of the cammed lever 10, opposite the lever tip 16. Cammed lever 10 is configured with lever stop 99 to engage the backrest 17, to prevent further rotational movement of cammed lever 10 in a counter clockwise manner, as illustrated in FIGS. 1A, 1B and 1C.

When the lock assembly A illustrated in FIG. 2A is fully assembled, the upper slide bar 50 abuts against the follower top edge 22 of follower slide 23, at the lower edge 54 of the upper slide bar 50. In a stacked array of similar lock assemblies A, upper edge 52 of upper slide bar 50 will abut against a corresponding edge 34 (not shown) of a corresponding bracket 30 of the similar assembly A situated immediately above, in abutting arrangement.

In the locking assembly A illustrated in FIG. 2A, track segment 70 defines a C-shaped channel 72. Bracket 30 is slide-fit within channel 72 by inserting a T-shaped slide (not shown) in abutting relation to lower slide bar 60. In locking assembly A, lower slide bar 60 is inserted within channel 72 adjacent the bottom edge of track segment 70 aligned along a longitudinal axis L. The lower slide bar 60 of lock assembly A acts as a spacer within channel 72 of track segment 70 between the bracket slide (not shown) of bracket 30 and the base slide 43. The bottom edge 34 (not shown) of the bracket slide abuts against a top edge 52 of a corresponding upper slide 50 of a similar assembly A installed in abutting relation below (not shown), or against an end wall of channel 72, if the assembly A is the lowest assembly within the stacked array. In turn, top edge 62 of lower slide bar 60 abuts against bottom edge 44 of the T-shaped base slide 43. Top edge 42 of the T-shaped base slide 43 abuts against bottom edge 24 of T-shaped follower slide 23. As previously noted, top edge 22 of follower slide 23 abuts against edge 54 of upper slide bar 50 in this embodiment. The lengths of top slide bar 50 and bottom slide bar 60 may be easily adapted to meet the spatial needs of the installation site. If needed, installation workers may easily cut and shape standard bar stock to length and width, at the installation site.

In the locked position, and in the closed (but unlocked position), the upper slide bar 50, follower slide 23, base slide 43, lower slide bar 60, and the bracket slide (not shown) are compressed in a fully abutting position within channel 72 of the track 70.

When the lock assembly A is positioned at the bottom of a vertically stacked array, the T-shaped slide defined in bracket 30 (not shown) and its bottom edge 34 (not shown) are positioned adjacent the lower end of channel 72 within track 70. Top edge 32 of the bracket 30 abuts against bottom edge 64 of lower slide bar 60.

When the lock assembly A is in the locked closed position (or the unlocked, closed position), bottom edge 24 of cam follower 20 abuts against top edge 32 of the T-shaped base slide 43.

When cammed lever 10 is rotated in a counter clockwise manner as illustrated through FIGS. 1A to 1C, lever peak 14 travels across beveled surface 25 of cam follower 20, and thus creating a gap G as lever tip 16 is fully displaced by drawer slide 1, at which point lever stop 99 is fully engaged with the backrest 17.

In FIGS. 3-7, two locked assemblies A are shown in a stacked array of upper drawer 80 and the lower drawer 84, in which the lock assemblies are slidable within a track 70' in a storage unit shown as cabinet 4. Upper drawer 80 is mounted on upper drawer slide 1. Lower drawer 84 is mounted on lower drawer slide 1'. The corresponding paired, lower drawer slides (not shown) which support lower drawer 84 are mounted on cabinet side wall 401. Upper drawer 80 is mounted on a pair of parallel opposed drawer slides 1 mounted on opposing cabinet side walls 401, 402. Similarly, lower drawer 84 is mounted on a pair of parallel, opposing drawer slides 1' mounted on side walls 401 and 402 of cabinet 4.

Figure 3:
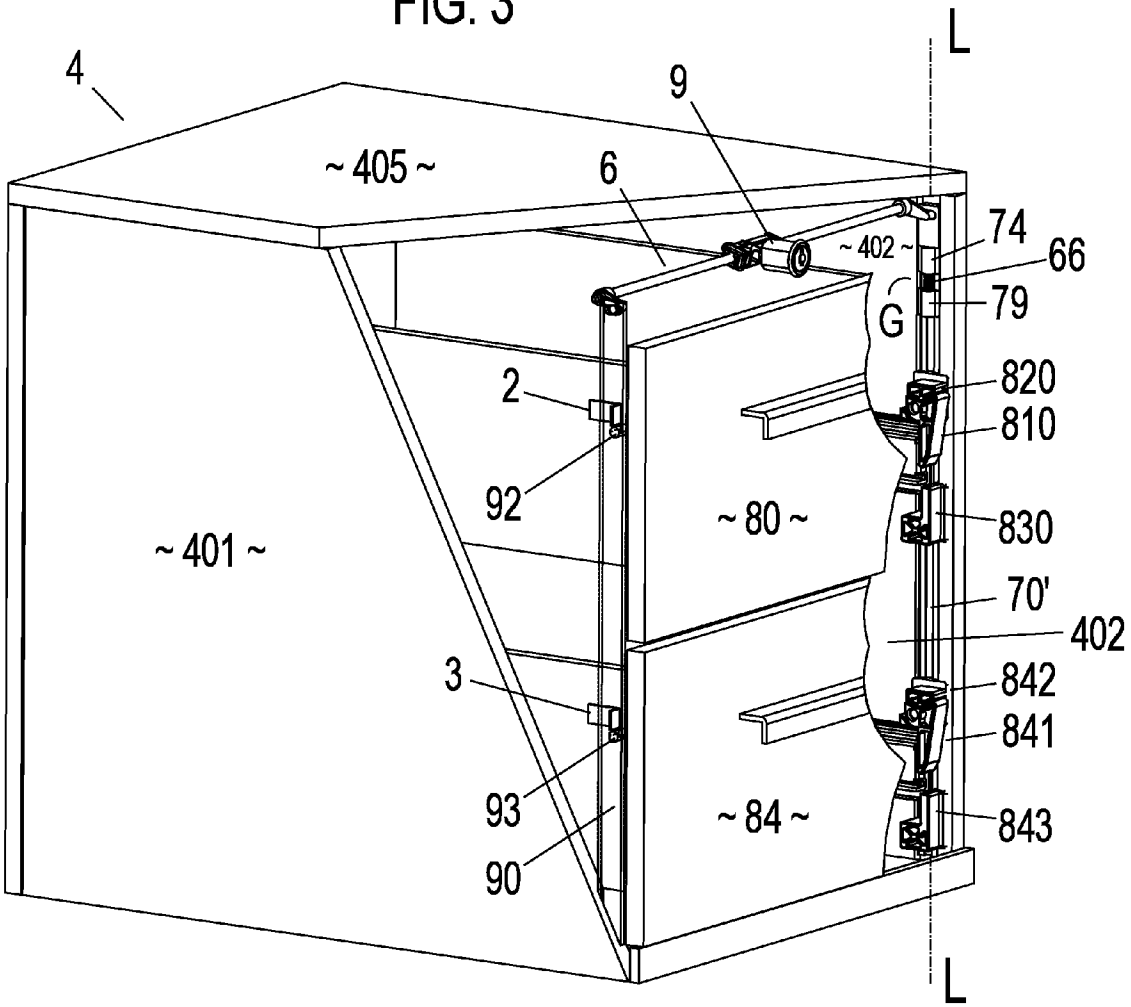
FIG. 3 shows a preferred embodiment of the locking system of the present invention, in partial section of a side view in perspective, when installed in an unlocked storage unit.
Figure 4:
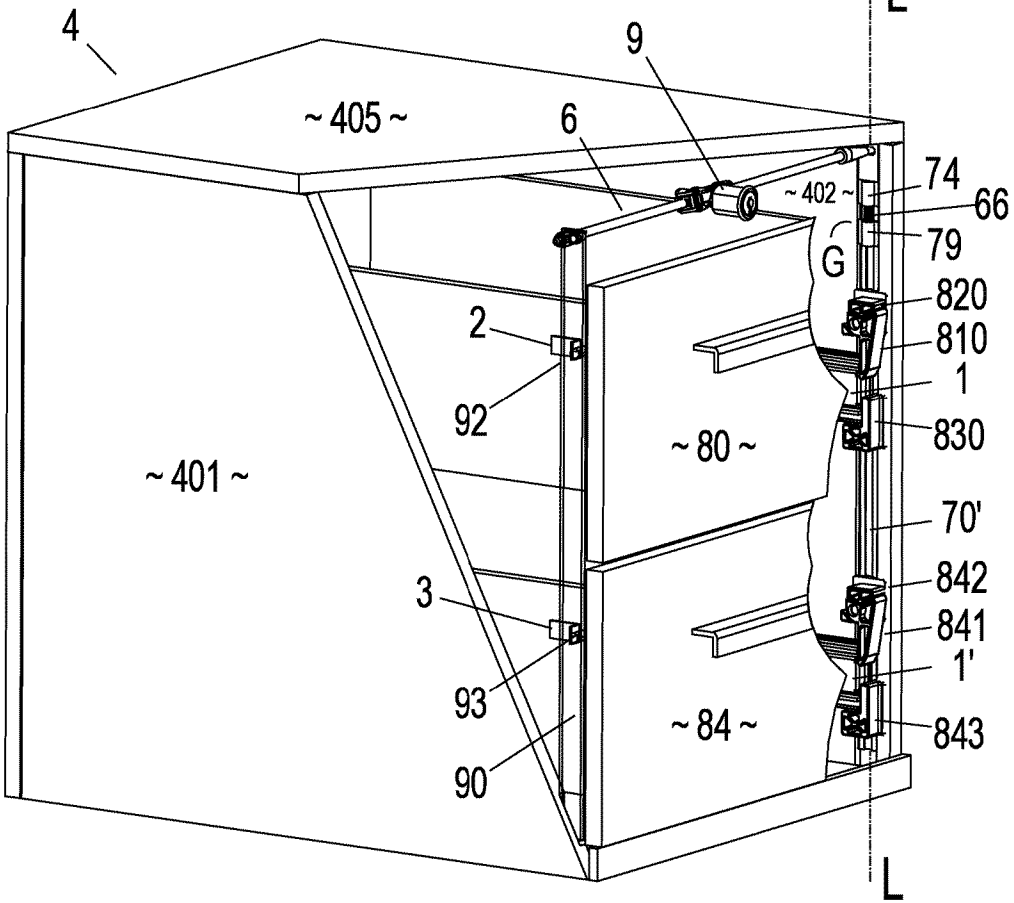
FIG. 4 shows a preferred embodiment of the locking system of the present invention, in partial section of a side view in perspective, installed in a locked storage unit.

In FIG. 3, cabinet 4 is shown in an unlocked position. Specifically, a key (not shown) can be inserted into lock cylinder 9 so that an operator may rotate the locked cylinder 9 and in turn rotate lock actuator bar 6 between an unlocked position (FIG. 3) and a locked position (FIG. 4). In the embodiment illustrated in FIG. 3, when the lock actuator bar 6 has been rotated to an unlocked position, lock bar 90 and track 70' are displaced downwardly within cabinet 4. Drawer pins 92, 93 which are mounted on lock bar 90 are similarly displaced downwardly beyond the lower edges of upper drawer stop 2 and lower drawer stop 3. When the lock bar 90 is downwardly displaced as shown, drawer stops 2, 3 may pass beyond drawer pins 92, 93 when a corresponding drawer 80 or 84 is opened. On opposing side wall 402, track 70' is displaced downwardly upon rotation of lock actuator bar 6 when the lock cylinder 9 is moved from the locked to the unlocked position. In the locking system shown having two identical lock assemblies A, the stacked assemblies A within the array are simultaneously displaced downwardly, creating a gap G at the upper end of the track, adjacent to the topmost edge of the topmost lock assembly, when moving the array from the locked position (FIG. 4) to the unlocked position (FIG. 3). In the unlocked position (FIG. 3), upper bracket 830 and lower bracket 843 are simultaneously displaced downwardly beyond the lower edges of upper drawer slide 1 and lower drawer slide 1', respectively. By lowering the brackets 830 and 843, one of the drawer slides 1, 1' will be allowed to move to the open position, closing the gap G as the cammed lever and the cam follower are separated by the predetermined distance. Similarly, the upper cammed lever 810 and lower cammed lever 841 are simultaneously displaced downwardly, moving from the locked position (FIG. 4) to the unlocked position (FIG. 3). In the unlocked position, upper cammed lever 810 and lower cammed lever 841 remain engaged with the leading edges of upper drawer slide 1 and lower drawer slide 1', respectively. When both drawers 80, 84 are in the closed position (FIG. 3 (unlocked) and FIG. 4 (locked)), upper cam follower 820 is fully engaged within the upper recess of upper cammed lever 810 and lower cam follower 842 is fully engaged with the recess in the top surface of lower cammed lever 841. Both sets of cammed levers and cam followers are similarly fully engaged in the locked position (FIG. 4). The lock actuator bar 6, keyed lock cylinder 9 and the related interior features of the illustrated locking system are positioned, in this embodiment, adjacent the upper surface 405 of the cabinet 4.

The illustrated track assembly 70' also includes a bottom plug 79 adapted to separate from the upper plug 74 by a predetermined distance 66 corresponding to the gap G. Preferably top plug 74 and lower plug 79 are biased toward separation by a spring urging both lock assemblies A toward the closed bottom end of track 70'. Lower bracket 843, in this embodiment, abuts against the lower closed end of track 70'.

Figure 5:
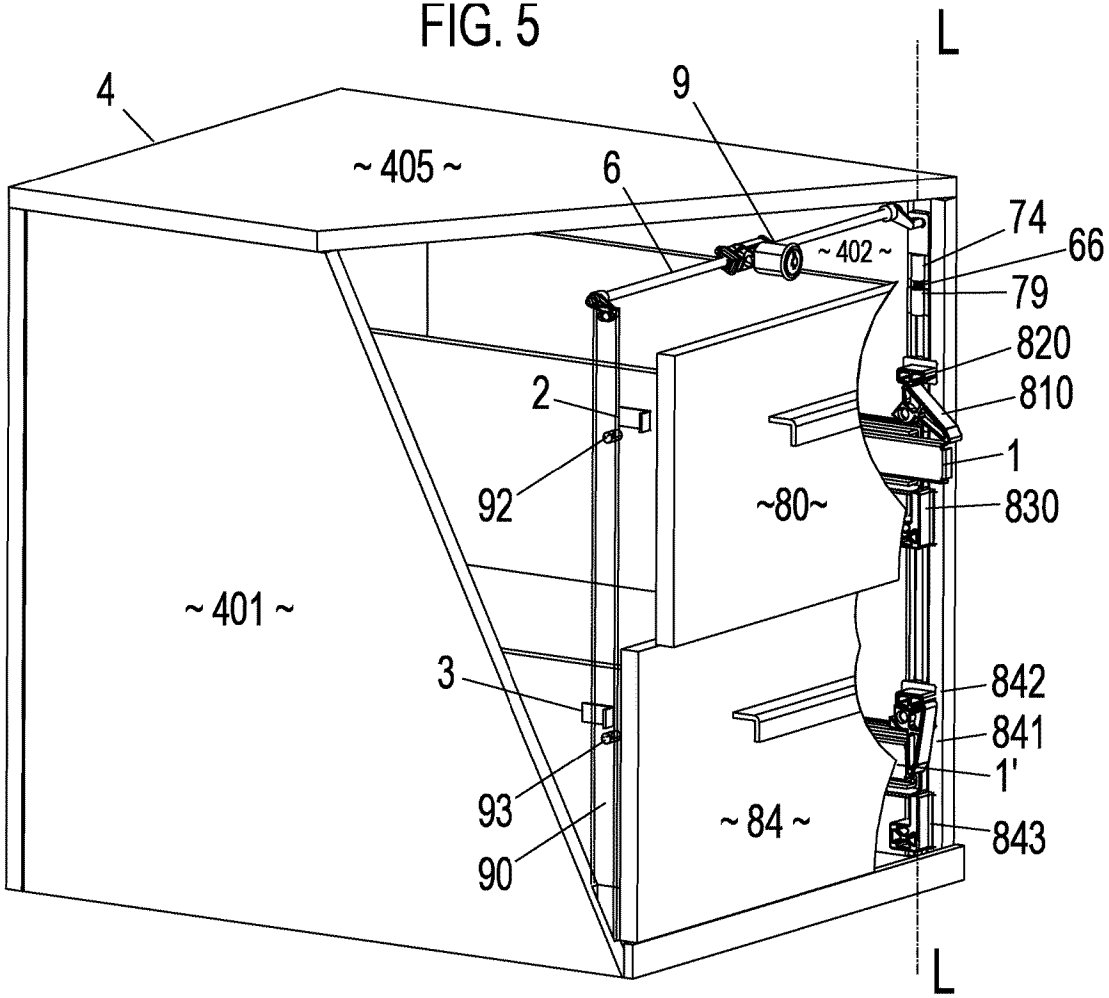
FIG. 5 shows a preferred embodiment of the locking system of the present invention, in partial section of a side view in perspective, installed in an unlocked storage unit, showing the initial opening of a top drawer of the storage unit.
Figure 6:
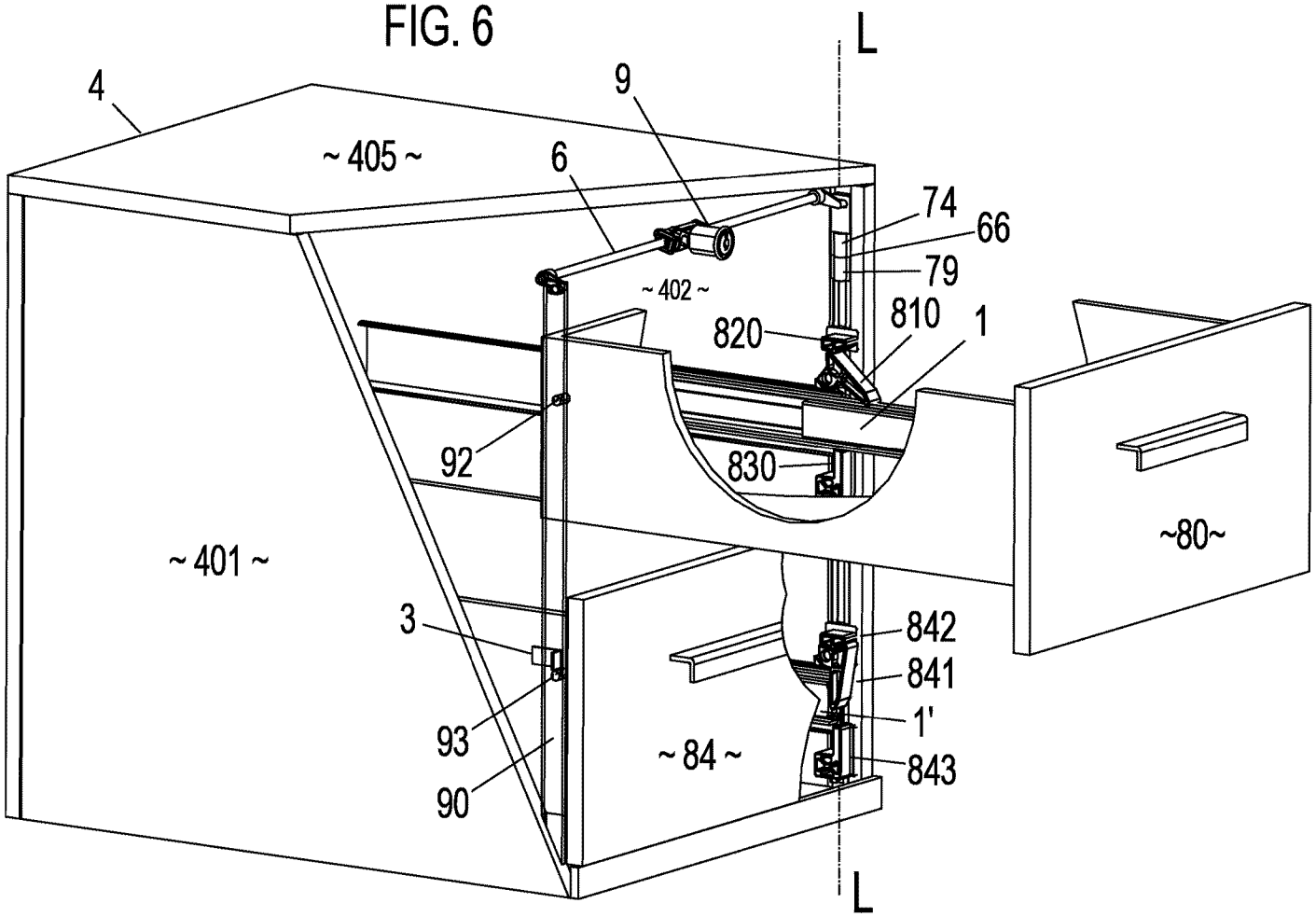
FIG. 6 shows a preferred embodiment of the locking system of the present invention, in partial section of a side view in perspective, installed in an unlocked storage unit, in which the top drawer is in a fully opened position.

FIGS. 5 and 6 illustrate, in sequence, the initial opening of the top drawer 80 (FIG. 5) followed by the fully opened drawer 80 as illustrated in FIG. 6. As upper drawer 80 is opened, upper drawer stop 2 (mounted on the sidewall of upper drawer 80 as shown in this embodiment) is allowed to pass by (and above) upper drawer pin 92. The lead edge of the upper drawer slide 1 engages the tip of upper cammed lever 810 which, in turn, causes counter clockwise rotation of cammed lever 810.

As upper drawer 80 and corresponding drawer slide 1 pass across longitudinal axis L, upper cammed lever 810 urges upper cam follower 820 upwardly, in turn urging an upper slide bar and lower plug 79 toward upper plug 74 to close the gap 66 when a corresponding gap G is formed between upper cam follower 820 and upper cammed lever 810 (within track 70'). When top drawer 80 is fully opened as shown in FIG. 6, gap 66 is closed and the gap G results by separation of the abutting edges of the T-shaped track slides of upper cam follower 820 and upper cammed lever 810 by the predetermined distance equal to gap G.

Figure 7:
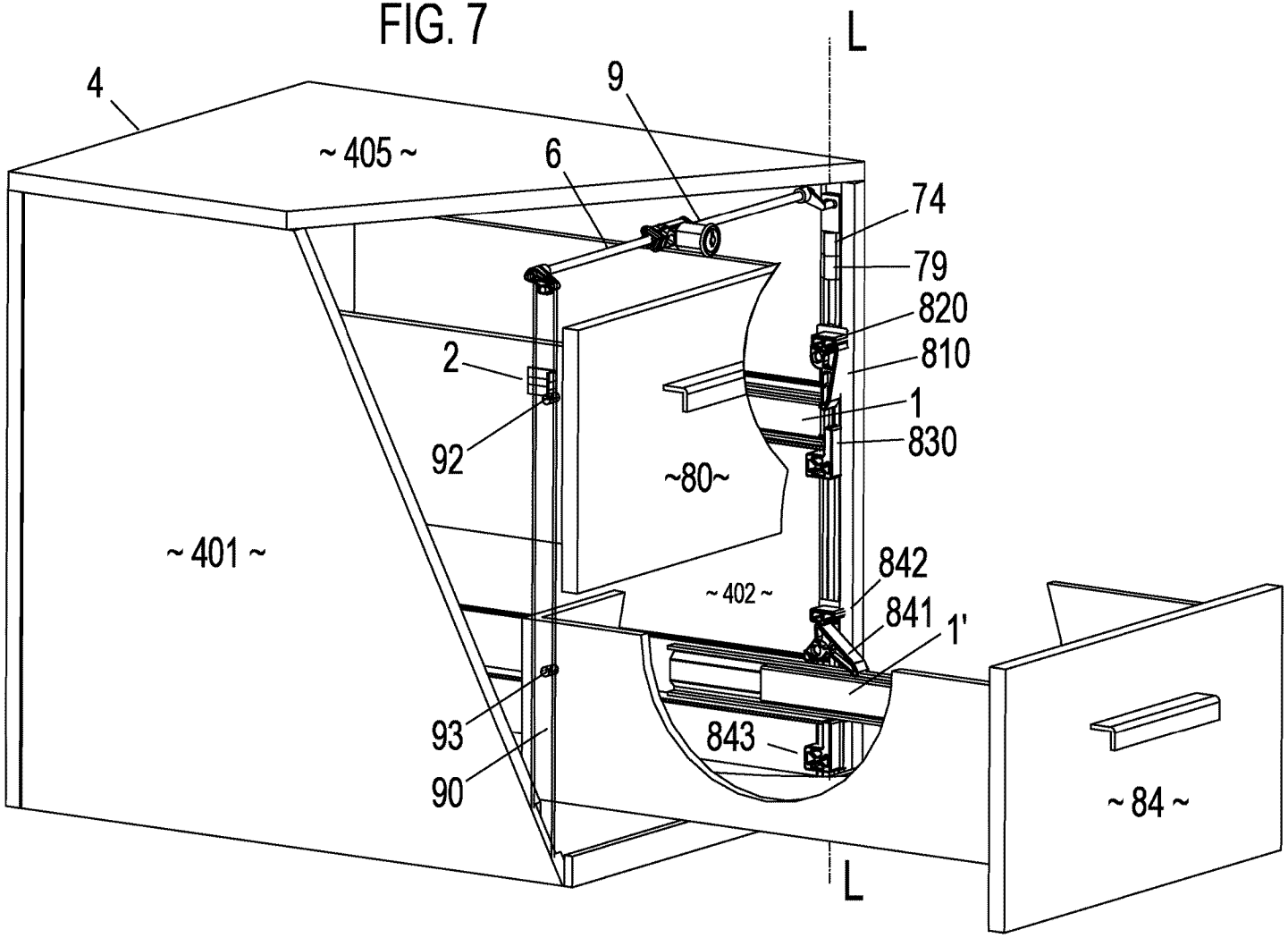
FIG. 7 shows a preferred embodiment of the locking system of the present invention, in partial section of a side view in perspective, installed in an unlocked storage unit, in which the bottom drawer is in a fully opened position.

In FIG. 7, the bottom drawer 84 is shown in a fully opened position. Lower drawer slide 1' has displaced lower cammed lever 841 (via counter clockwise rotation) to urge lower cam follower 842 upwardly through a displacement of a predetermined distance equal to gap G. The upper slide bar of lower lock assembly A abuts against lower slide segment 60 of the upper lock assembly A. The upward displacement of the cam follower and slide bar in upper lock assembly A closes the gap G between upper plug 74 and lower plug 79 while the gap G is simultaneously opened between lower cam follower 842 and lower cammed lever 841. It will be understood that only one drawer is permitted to open when gap 66 is closed by the opening of either the upper drawer 80 or lower drawer 84.

FIG. 2B illustrates a variant of the cammed lever 10' in which a lever guard 100 is provided. The lever guard 100 may be made of a material which is different in composition and properties from the surrounding structure of modified cammed lever 10'. For example, lever guard 100 may be made from a material selected for its insulative qualities, resistance to wear and noise reduction capabilities when operating in contact with the other moving parts of the lock system or the components within a storage unit such as cabinet 4. A modified cam follower may be configured with a cam follower recess (not shown) to receive and nest with the elevated surface of lever guard 100. In FIG. 2C, modified cam follower 20' is provided with a follower guard 26. The follower guard 26 may also be selected from a material which differs in composition and other qualities compared to the surrounding material of modified follower 20'. In the illustrated embodiment of the lock assembly shown in FIG. 2C, modified lever base 40' is insulated with a material of alternate composition forming a retainer guard 19'. Lever guard 100, follower guard 26, and retainer guard 19', may also be fitted with insulated, wear resistant features. Similarly, additional recesses (not shown) may be provided, for example, on the opposing contact surfaces of the backrest and the recess, if desired, to receive and nest with the elevated surfaces of one or more of the insulated and/or wear resistant guard elements.

The invention also provides a kit which may be used in retro fit applications to replace worn or broken components in a storage structure, for example, a storage unit such as a cabinet. For example, each kit may include a track segment 70 as illustrated in FIG. 2A, 2B or 2C. The kit may also include upper and lower slide bar segments 50, 60 of appropriate length, bracket 30, upper base 40, cam follower 20, cammed lever 10 and fastener 11, to replace worn or broken components in an existing storage structure or locking system.

An additional length of track may be provided to vertically stack multiple lock assemblies A in vertical abutting relation operating in association with a corresponding number of opening drawers or other storage compartments. Each track segment 70 may be detachably secured to a longer track support so that all of the locking systems A are secured in abutting alignment along the track support, so that a predetermined distance corresponding to gap 66 is formed within the assembled track support. When this embodiment is fully assembled, only one lock assembly within the locking system will be permitted to open when one cammed lever is fully rotated upon opening of an associated drawer and the cam follower associated with that cammed lever is displaced to form a gap G equivalent to the predetermined distance 66. In other embodiments, the gap G may be adapted to permit more than one lock assembly to simultaneously open in a stacked array, if desired.

In FIG. 2D, an embodiment is shown in which the gap G, defined by the predetermined distance 66*a*, is defined between an upper and lower lock assembly. In this example, a two-drawer lock assembly Aa includes a fixed track segment 70*a* which is secured to the side wall of a storage structure such as a cabinet (not shown) by two end screws 11*a* and 11*b*. End screws 11*a* and 11*b* are also used to secure the top cammed lever 10*a* and bottom cammed lever 10*b* relative to the track 70*a* and the track assembly Aa including the track 70*a* to the side wall of the cabinet (which is not shown). In the orientation shown in FIG. 2D, the lock assembly Aa is either locked or unlocked. A lock bar (not shown) may be used to securely separate top plug 74*a* and bottom plug 79*a* by occupying the space between channels 7*a*, 7*b* in top and bottom plugs 74*a*, 79*a*, respectively when the storage cabinet is locked. The storage unit may be unlocked by withdrawing such a lock bar (not shown) by one of a variety of locks (also not shown) which may be used to lock and unlock the lock assembly Aa. Spring 18 is an example of a feature which may be used to urge apart and separate the top plug 74*a* and bottom plug 79*a* when the two drawers are closed so that the lock bar (not shown) may be easily reinserted into the space between channels 7*a*, 7*b* in top and bottom plugs 74*a*, 79*a*, respectively.

In FIG. 2D, the upper retainer 19*a* provides a backrest configured as a stop to limit the rotational movement of upper cammed lever 10*a* during outward displacement of an associated upper drawer slide (not shown). Similarly, the lower retainer 19*b* provides a backrest configured as a stop to limit the rotational movement of lower cammed lever 10*b* during outward displacement of an associated lower drawer slide (also not shown).

The upper lever tip 16*a* and the lower lever tip 16*b* interact with corresponding upper and lower drawer slides (not shown) in a two-drawer storage cabinet (also not shown). For example, when an upper drawer (not shown) is opened, the associated drawer slide (also not shown) will be extended outwardly from the storage cabinet, while rotating the associated upper lever cammed lever 10*a* by acting on upper lever tip 16*a*, to displace (downwardly) upper cam follower 20*a*, upper slide bar 50*a*, and top plug 74*a* along track 70*a*, and in turn to close the predetermined gap 66*a* between top plug 74*a* and bottom plug 79*a*. By way of further example, when a lower drawer (not shown) is opened, the associated drawer slide (also not shown) will be extended outwardly from the storage cabinet, while rotating the associated lower lever cammed lever 10*b* by acting on upper lever tip 16*b*, to displace (upwardly) lower cam follower 20*b*, lower slide bar 60*a*, and bottom plug 79*a* along track 70*a*, and in turn to close the predetermined gap 66*a* between top plug 74*a* and bottom plug 79*a*. Thus, when one of the two drawers in a two-drawer array (for example, in a two drawer storage cabinet), the gap 66*a* will be closed to inhibit the opening of the other drawer in the two drawer array.

Persons skilled in the art will appreciate that other variations of the embodiment in FIG. 2D may include lock assembly arrays for use in association with more than two drawers stacked in a vertical arrangement having a predetermined gap G defined between at least one lower lock assembly and at least one upper lock assembly, on opposing sides of the gap G. For example, the one or more additional lock assemblies may be slide fit for movement within a longer track configured to accommodate the additional space occupied by the additional lock assemblies. In this example, the additional lock assemblies will be suitably oriented, based on whether their positions are above or below the gap G.

This invention also includes other embodiments. For example, locking systems may include a lock, a lock actuator bar which is mechanically connected to the lock, a lock bar and a removable track assembly installed within a stacked array of storage compartments, including drawers and the like. In the preferred embodiment illustrated in FIGS. 3 to 7, a keyed lock cylinder, and a lock actuator bar are similar in design to a preferred offset swivel crank arm mechanism described in U.S. Pat. No. 6,698,258. However, persons skilled in the art will appreciate that other components and mechanisms may be used in conjunction with the components, assemblies, locking systems, kits, and structures of the present invention.

The invention may be configured and installed in anti-tip systems for movable storage units having multiple storage compartments such as retractable drawers. Where anti-tip systems are desirable, it will be appreciated that the locking system of the present invention may be adapted to inhibit tampering that could allow simultaneous withdrawal of more than one drawer from the movable storage unit.

Having regard to the examples provided by the illustrated embodiments of the invention, the locking system and other variants of the invention may be installed to inhibit the cabinets or other movable storage units from tipping over. In these examples, once a drawer slide associated with one retractable drawer in a stacked array activates the cammed lever associated with that drawer slide, the cammed lever and the other components within the locking system are restrained (to inhibit withdrawal of another retractable drawer) until the associated drawer slide is fully returned to its retracted position.

Various materials may be used to form the components of the cammed lever, lock assembly, locking system, storage structures and other embodiments of the present invention, as would be evident to a skilled person.

Also, it should be understood that the above-described embodiments of the present invention, particularly, any "preferred" embodiments, are only examples of implementations, which are merely set forth to better understand the principles of the invention. Many variations and modifications may be made to the above-described embodiment(s) of the invention as will be evident to those skilled in the art. Additional embodiments and variations are possible and such embodiments and variations will fall within the scope of the appended claims.

In this document where a list of one or more items is prefaced by the expression "such as" or "including", or is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "having", "comprises" and "comprising", when used in this specification and the claims, are used to specify the presence of stated features, elements, integers, steps or components, and do not preclude, nor imply the necessity for, the presence or addition of one or more other features, elements, integers, steps, components or groups thereof.

Nothing in this specification or the claims that follow is to be construed as a promise.

The scope of the claims that follow is not limited by the embodiments set forth in the description. The claims should be given the broadest purposive construction consistent with the description as a whole.

PARTS LIST FOR ILLUSTRATED EMBODIMENTS

A=lock assembly
Aa=two-drawer lock assembly
L=longitudinal axis
G=gap
1=drawer slide
1'=lower drawer slide
2=upper drawer stop
3=lower drawer stop
4=cabinet
5=beveled recess
6=lock actuator bar
7*a*=upper lock bar channel
7*b*=lower lock bar channel
9=keyed lock cylinder
10=cammed lever
10'=insulated cammed lever
10*a*=upper cammed lever
10*b*=lower cammed lever
11=fastener
11*a*=upper screw
11*b*=lower screw
12=opening
13=recess
14=lever peak
15=mounting post
16=lever tip
16*a*=upper lever tip
16*b*=lower lever tip
17=back rest
18=spring
19=retainer
19*a*=upper retainer
19*b*=lower retainer
19'=retainer guard
20=cam follower
20*a*=upper cam follower
20*b*=lower cam follower
20'=modified cam follower
22=top edge follower slide
23=follower slide
24=bottom edge follower slide
25=beveled surface
26=follower guard
30=bracket
32=top edge bracket slide
34=bottom edge bracket slide
36=bracket tip
40=lever base
40'=insulated lever base
42=top edge base slide
43=base slide
44=bottom edge base slide
50=upper slide bar
50*a*=upper slide bar
52=upper edge
54=lower edge
60=lower slide bar
60*a*=lower slide bar
62=top edge
64=bottom edge
66=gap
66*a*=gap
70=track
70*a*=track
72=channel
74=top plug
74*a*=top plug
79=bottom plug
79*a*=bottom plug
80=upper drawer
84=lower drawer
90=lock bar
92=drawer pin
93=drawer pin
99=lever stop
100=lever guard
401=cabinet side wall
402=cabinet side wall
405=cabinet top
810=upper cammed lever
820=upper cam follower
830=upper bracket lever
841=lower cammed lever
842=lower cam follower
843=lower bracket

What is claimed is:

1. A lock assembly for use with a storage compartment in a storage structure, the lock assembly comprising:

an elongated cammed lever extending along its length between a first end and a second end configured for cooperative engagement of the second end of the cammed lever with a leading edge of a drawer slide associated with the storage compartment for activation by lateral movement of the drawer slide associated with the storage compartment when the lock assembly is installed in the storage structure, wherein the storage compartment is supported by the drawer slide, one of the first end of the cammed lever and a cam follower adjacent the first end of the cammed lever, defining a camming surface, another one of the first end of the cammed lever and the cam follower defining a nesting surface for nesting in a curved nesting recess in the camming surface when the cam follower is in an unlocked closed position or a locked position, the cam follower inhibiting operational movement of the cammed lever relative to the cam follower and the second end of the cammed lever being configured to inhibit opening of the drawer slide when the cam follower is in the locked position, wherein the cam follower and the cammed lever are configured for cooperative displacement of one or both of the cammed lever and the cam follower along a longitudinal axis, and upon installation of the lock assembly in the storage structure, when the drawer slide is extended laterally outwardly across the longitudinal axis, the leading edge of the drawer slide engages the second end of the cammed lever and moves the cammed lever to an open position as the nesting surface on the other of the first end of cammed lever and the cam follower moves from the curved nesting recess and outwardly along the camming surface, to cooperatively displace one or both of the cammed lever and the cam follower along the longitudinal axis by a predetermined distance.

2. In the lock assembly claimed in claim 1, the first end of the cammed lever defines the nesting recess and the camming surface, and the cam follower defines the nesting surface which moves from the nesting recess and outwardly along the camming surface when the drawer slide is extended laterally outwardly across the longitudinal axis.

3. A lock assembly for use with a storage compartment in a storage structure, the lock assembly comprising:

a cammed lever positioned along a longitudinal axis, the cammed lever defining an elongated body extending between a first end defining a camming surface and a second end defining a lever for abutting engagement with a leading edge of a drawer slide associated with the storage compartment upon lateral movement of the drawer slide across the longitudinal axis, wherein the storage compartment is supported by the drawer slide, a cam follower positioned adjacent to the cammed lever and along the longitudinal axis, the cam follower nesting in a curved nesting recess in the camming surface when the cam follower is in an unlocked closed position or a locked position, the cam follower inhibiting operational movement of the cammed lever relative to the cam follower and the second end of the cammed lever configured to inhibit opening of the drawer slide when the cam follower is nested in the curved nesting recess in the locked position, the cam follower and the cammed lever being configured for cooperative separation along the longitudinal axis, and upon installation of the lock assembly in the storage structure, when the drawer slide is extended laterally outwardly away from the longitudinal axis, the leading edge of the drawer slide moves the cammed lever to an open position as the cam follower moves from the curved nesting recess and outwardly along the camming surface, for cooperative separation of the cammed lever and the cam follower by a predetermined distance along the longitudinal axis.

4. The lock assembly claimed in claim 2, comprising a stackable pair of sliding lock bars for associated use with the drawer slide in an array of paired locking bars along the longitudinal axis, the stackable pair of locking bars comprising:

a first lock bar for movable displacement along the longitudinal axis adjacent to the cam follower, and a second lock bar for movable displacement along the longitudinal axis adjacent the cammed lever, the distance between the first lock bar and the second lock bar changing by the predetermined distance when the cammed lever moves to the open position upon abutting contact of the cammed lever with the drawer slide as the nesting surface disengages from the nesting recess.

5. In the lock assembly claimed in claim 1, when the lock assembly is assembled along the longitudinal axis adjacent the leading edge of the drawer slide, the cammed lever moves from the open position to a closed position when the drawer slide is moved laterally inwardly toward the longitudinal axis, and the cam follower and the cammed lever converge for nested engagement at the recess when the cam follower moves to the unlocked closed position.

6. In the lock assembly claimed in claim 1, when the lock assembly is assembled along the longitudinal axis adjacent the leading edge of the drawer slide, the lock assembly cooperating with a second lock assembly of similar construction assembled for cooperative separation from the second lock assembly along the longitudinal axis adjacent a leading edge of a second drawer slide, wherein a second end of a second elongated cammed lever in the second lock assembly abuts against the leading edge of the second drawer slide to inhibit the second drawer slide from moving laterally outwardly from the longitudinal axis, when the cammed lever in the lock assembly moves to the open position as the cam follower and the cammed lever disengage from nested engagement at the recess.

7. In the lock assembly claimed in claim 1, the cammed lever is configured for abutting contact with the leading edge of the drawer slide associated with the storage compartment when the drawer slide is extended laterally outwardly away from the longitudinal axis and to separate the cam follower and the cammed lever along the longitudinal axis by the predetermined distance, and the cammed lever rotates about the longitudinal axis to disengage the cam follower and the cammed lever at the recess.

8. In the lock assembly claimed in claim 1, the second end of the cammed lever is configured for abutting contact with the leading edge of the drawer slide when the storage compartment is opened laterally outwardly across the longitudinal axis, thereby rotating the cammed lever to move the cam follower along the longitudinal axis by the predetermined distance while the cam follower and the cammed lever disengage at the recess.

9. The lock assembly claimed in claim 1 wherein the cammed lever defines a rigidly resilient body comprising a wear resistant bearing surface extending for abutting engagement with the cam follower at the recess and outwardly from the recess along a camming surface adjacent to the recess.

10. The lock assembly claimed in claim 1 wherein the cammed lever defines a rigidly resilient body comprising a cushioning element extending between the recess and outwardly along the camming surface for abutting engagement between the cam follower and the cammed lever.

11. The lock assembly claimed in claim 10, wherein the cushioning element defines a wear resistant bearing surface.

12. The lock assembly claimed in claim 9, wherein the rigidly resilient body comprises at least two layers, a first layer of a first material and a second layer of a second material different from the first material, the first material defining a rigidly resilient core, and the second material defining a cushioned wear resistant bearing surface extending beyond an outer edge of the rigidly resilient core, for abutting engagement against the cam follower, when the lock assembly is installed for interactive operation associated with the drawer slide within the storage structure.

13. A locking system for use in a storage structure having at least two lock assemblies comprising a first lock assembly and a second lock assembly arranged in abutting relation along a longitudinal axis defined by a track, each lock assembly operating in association with an associated storage compartment supported on an associated drawer slide, the first lock assembly comprising:

a cammed lever defining a first end of an elongated body, the cammed lever engaging a leading edge of the drawer slide associated with the first lock assembly when the cammed lever is installed in the storage structure and the first locking system is in a locked position or in an unlocked closed position, the first end of the elongated body and a cam follower in nesting engagement at a curved recess defined by the cam follower or the first end of the elongated body when the cam follower is in the unlocked closed position or the locked position, the cam follower and the cammed lever being configured to inhibit operational unnesting of the cammed lever and the cam follower at the recess and to inhibit lateral outward movement of the drawer slide associated with the first lock assembly across the longitudinal axis when the cam follower and the first end of the elongated body are nested at the recess in the locked position, the cam follower and the cammed lever being configured for cooperative aligned displacement along the track when the cam follower is unlocked, the cammed lever and the cam follower are unnested at the recess and a locking bracket movably mounted on the track opposite the cammed lever disengages the leading edge of the drawer slide, and the cammed lever is rotated upon abutting engagement with the leading edge of the drawer slide associated with the first lock assembly during laterally outward movement of the drawer slide associated with the first lock assembly across the longitudinal axis, a first lock bar for movable displacement along the track adjacent to the cam follower, and a second lock bar for movable displacement along the track adjacent the cammed lever, a separation distance between the first lock bar and the second lock bar changing by a predetermined distance when the cammed lever moves to an open position as the cam follower and the first end of the elongated body are unnested at the recess.

14. The locking system claimed in claim 13, comprising a cushioned wear resistant portion extending between the recess and a camming surface adjacent the recess for operational contact between the cam follower and the cammed lever.

15. In the locking system claimed in claim 14, the cushioned wear resistant portion extends along the surface of the recess and the camming surface.

16. In the locking system claimed in claim 13, the cammed lever is rotatably mounted on a first slider segment configured to move along the track.

17. In the locking system claimed in claim 16, the first lock bar defines the first slider segment.

18. In the locking system claimed in claim 13, the cammed follower comprises a second slider segment configured to move along the track.

19. In the locking system claimed in claim 18, the second lock bar defines the second slider segment and the second slider segment comprises the locking bracket.

20. In the locking system claimed in claim 13, when a second cam follower and a second cammed lever in the second lock assembly are cooperatively displaced along the track by the predetermined distance upon lateral outward movement across the longitudinal axis by the second drawer slide and the second storage compartment associated with the second lock assembly upon engagement of the second cammed lever with a leading edge of the second drawer slide, the cam follower and the cammed lever in the first lock assembly remain nested in locking engagement at the recess to prevent lateral outward movement of the storage compartment associated with the first lock assembly across the longitudinal axis.

21. The locking system claimed in claim 13, comprising a locking bracket movable along the longitudinal axis in cooperation with the cammed lever in the first lock assembly, for abutting engagement of the locking bracket with the leading edge of the drawer slide to inhibit outward movement of the drawer slide associated with the first lock assembly in the locked position, and the locking bracket cooperating with the cam follower in the first lock assembly to permit outward movement of the drawer slide associated with the first lock assembly in the unlocked position when the cammed lever is rotated by the leading edge of the drawer slide.

22. The lock assembly claimed in claim 1, wherein a locking bracket is movable along the longitudinal axis in cooperation with the cammed lever, for locking engagement of the locking bracket and the second end of the cammed lever with the leading edge of the drawer slide, to inhibit outward movement of the drawer slide in the locked position, and the locking bracket cooperating with the cam follower to permit outward movement of the drawer slide in the unlocked position.

23. The lock assembly claimed in claim 1, wherein one or both of the lock assembly and an adjacent lock assembly of similar construction are displaced along the longitudinal axis by the predetermined distance when the drawer slide is extended laterally outwardly across the longitudinal axis.

24. The lock assembly claimed in claim 23 is locked when a lock bar is moved along the longitudinal axis by the predetermined distance.

25. A storage structure comprising the lock assembly claimed in claim 1.

26. A storage structure comprising the lock assembly claimed in claim 3.

27. A storage structure comprising the locking system claimed in claim 13.

28. A kit for assembly and installation of the locking system claimed in claim 13 within the storage structure, the kit comprising:

a track segment, the cammed lever configured for slide-fit installation within the track segment, to abut against the leading edge of the drawer slide, the cam follower configured for slide-fit installation within the track segment, a locking bracket configured to move along the track segment in cooperation with the cammed lever to inhibit outward movement of the drawer slide in the locked position, the locking bracket configured to abut against the leading edge of the drawer slide when installed on the track segment in the locked position, and the locking bracket cooperating with the cam follower to permit outward movement of the drawer slide in the unlocked position, and the first and second locking bars configured for slide-fit installation within the track segment.

29. A kit for assembly and installation of the locking system claimed in claim 3 for cooperative engagement of the cammed lever with a leading edge of the drawer slide within the storage structure, the kit comprising:

a track segment, the cammed lever configured for slide-fit installation within the track segment, and for securing one end of the track segment and the cammed lever to the storage structure, the cam follower configured for slide-fit installation and for moving within the track segment relative to the cammed lever, and a pair of blocks to define the predetermined distance therebetween when installed in the track segment and when the blocks are unlocked and the cam follower is cooperatively separated from the cammed lever.

30. A storage structure comprising:

a first storage compartment mounted on a first slide and a second storage compartment mounted on a second slide in a vertically stacked array, a track providing an operational gap of a predetermined distance, a first locking assembly associated with the first storage compartment, and a second locking assembly associated with the second storage compartment, for operational displacement of the first locking assembly or the second locking assembly, the operational displacement being equal to the predetermined distance, when moving from an unlocked closed position to an open position, the first locking assembly comprising:

a first cammed lever having a second end abutting against a first leading edge of the first slide to inhibit opening of the first storage compartment when the first locking assembly is in the locked position, or when the second locking assembly is operationally displaced equal to the predetermined distance in the open position, a first cam follower abutting against a first end of the first cammed lever along a camming interface, the camming interface defining a nesting surface and a recess for receiving the nesting surface when the first locking assembly is in the locked position or the unlocked closed position, and when unlocked and the first storage compartment is withdrawn from the storage structure, and the first locking assembly is moved from the unlocked closed position to the open position, the first slide moves the second end of the first camming lever to unnest the nesting surface from the recess, one of the first cam follower and the first cammed lever is operationally displaced equal to the predetermined distance, and a second cammed lever in the second locking assembly abuts against the second slide, to inhibit opening of the second slide.

31. In the storage structure claimed in claim 30, a second end of the second cammed lever abuts against a second leading edge of the second slide when the second locking assembly is in the locked position, or the first locking assembly is operationally displaced equal to the predetermined distance in the open position, and the first and second leading edges are adjacent the track in the locked position.

32. In the storage structure claimed in claim 31, when in the locked position, the first cammed lever engages the first leading edge of the first slide to prevent opening of the first storage compartment and the second cammed lever engages the second leading edge of the second slide to prevent opening of the second storage compartment.

33. In the storage structure claimed in claim 30, a first locking bracket movably mounted on the track opposite the first cammed lever engages an edge of the first slide to inhibit opening of the first slide in the locked position or when the second locking assembly is in the unlocked closed position.

34. In the lock assembly claimed in claim 1, the cammed lever and the cam follower are configured for planar alignment with the leading edge of the drawer slide upon installation of the lock assembly in the storage structure for movement along the longitudinal axis.

35. In the lock assembly claimed in claim 3, the cammed lever and the cam follower are configured for installation in the storage structure along the longitudinal axis, in planar alignment with the leading edge of the drawer slide.

36. In the locking system claimed in claim 13, the cammed lever and the cam follower are configured for installation in the storage structure in planar alignment with the leading edge of the drawer slide.

37. In the structure claimed in claim 33, the first locking bracket, first cammed lever and the first cam follower are stacked on the track in planar alignment with the first slide.

38. In the storage structure claimed in claim 30, the first end of the cammed lever defines the recess and the cam follower defines the nesting surface.

39. In the storage unit claimed in claim 30, the first cam follower and the first cammed lever are operationally separated by the predetermined distance when one of the first cam follower and the first cammed lever is operationally displaced equal to the predetermined distance.

40. A lock assembly for use with a storage compartment in a storage structure, the lock assembly comprising:

a cammed lever extending along its length between a first end and a second end configured for cooperative movements with a leading edge of a drawer slide associated with the storage compartment for activation by lateral movement of the drawer slide associated with the storage compartment when the lock assembly is installed in the storage structure, wherein the storage compartment is supported by the drawer slide, one of the first end of the cammed lever and a cam follower adjacent the cammed lever, defining a camming surface, another one of the first end of the cammed lever and the cam follower defining a nesting surface for nesting in a curved nesting recess in the camming surface when the cam follower is in an unlocked closed position or a locked position, the cam follower inhibiting operational movement of the cammed lever relative to the cam follower and the second end of the cammed lever being configured to inhibit opening of the drawer slide when the cam follower is in the locked position, wherein the cam follower and the cammed lever are configured for cooperative displacement of one or both of the cammed lever and the cam follower along a longitudinal axis defined by a track, a locking bracket configured to be movably mounted on the track opposite the cammed lever upon installation of the lock assembly in the storage structure, the locking bracket engages the leading edge of the drawer slide to inhibit opening of the drawer slide in the locked position and the locking bracket disengages the leading edge of the drawer slide in the unlocked position, and upon installation of the lock assembly in the storage structure, when the drawer slide is extended laterally outwardly across the longitudinal axis, the leading edge of the drawer slide moves the cammed lever to an open position as the nesting surface on the other of the first end of the cammed lever and the cam follower moves from the curved nesting recess and outwardly along the camming surface, to cooperatively displace one or both of the cammed lever and the cam follower along the longitudinal axis by a predetermined distance.

* * * * *